US012123157B1

(12) United States Patent
Lei et al.

(10) Patent No.: US 12,123,157 B1
(45) Date of Patent: Oct. 22, 2024

(54) DELAMINATED SUBWAY STATION STRUCTURE IN SEA-LAND CONNECTION REGION AND CONSTRUCTION METHOD THEREOF

(71) Applicants: Beijing Urban Construction Design&Development Group Co., Limited, Beijing (CN); Gang Lei, Beijing (CN); Fucai Hua, Beijing (CN)

(72) Inventors: Gang Lei, Beijing (CN); Fucai Hua, Beijing (CN); Zhihui Yang, Beijing (CN); Kaijian Wang, Beijing (CN); Jianye Zhu, Beijing (CN); Chao Li, Beijing (CN); Liang Zhang, Beijing (CN)

(73) Assignees: Beijing Urban Construction Design & Development Group Co., Limited, Beijing (CN); Gang Lei, Beijing (CN); Fucai Hua, Beijing (CN)

( * ) Notice: Subject to any disclaimer, the term of this patent is extended or adjusted under 35 U.S.C. 154(b) by 0 days.

(21) Appl. No.: 18/403,752

(22) Filed: Jan. 4, 2024

(30) Foreign Application Priority Data

Apr. 23, 2023 (CN) ..... 202310436343.1

(51) Int. Cl.
*E02D 29/045* (2006.01)

(52) U.S. Cl.
CPC ..... *E02D 29/045* (2013.01)

(58) Field of Classification Search
CPC ..... E02D 29/045; E21D 13/00; E21D 9/00; E21D 11/08; E21D 11/10
See application file for complete search history.

(56) References Cited

U.S. PATENT DOCUMENTS

| | | | |
|---|---|---|---|
| 2004/0064905 | A1 | 4/2004 | Markelz |
| 2007/0006401 | A1 | 1/2007 | Thomson |
| 2014/0363236 | A1 | 12/2014 | Vanbuskirk |

FOREIGN PATENT DOCUMENTS

| | | | | |
|---|---|---|---|---|
| JP | 2005036435 A | * | 2/2005 | |
| RU | 2715493 C1 | * | 2/2020 | ..... E02D 29/00 |

* cited by examiner

*Primary Examiner* — Sunil Singh
(74) *Attorney, Agent, or Firm* — True Shepherd LLC; Andrew C. Cheng

(57) ABSTRACT

A delaminated subway station structure in a sea-land connection region includes an openly-excavated station hall, a platform floor, a first air shaft duct, a second air shaft, up and down entrances and exits, a barrier-free entrance and exit, and an under-rail street passage, where the platform floor is formed by expanding an existing running tunnel, such that a double-vault structure of the platform floor is formed; two groups of up and down entrances and exits are disposed, and located in waiting regions on two sides respectively to connect expanded ear chambers on two sides and the openly-excavated station hall; two groups of barrier-free entrances and exits are disposed, and located in the waiting regions on the two sides respectively; and the under-rail street passage is closely attached to a bottom plate of the existing running tunnel to form an underpass and connects to the expanded ear chambers.

5 Claims, 17 Drawing Sheets

DELAMINATED SUBWAY STATION STRUCTURE IN SEA-LAND CONNECTION REGION AND CONSTRUCTION METHOD THEREOF

CROSS-REFERENCE TO RELATED APPLICATIONS

This application claims priority to Chinese Patent Application No. 202310436343.1 with a filing date of Apr. 4, 2023. The content of the aforementioned application, including any intervening amendments thereto, is incorporated herein by reference.

TECHNICAL FIELD

The present disclosure relates to the technical field of underground engineering, and in particular, to a delaminated subway station structure in a sea-land connection region and a construction method thereof.

BACKGROUND

With the economic development and the promotion of green travel, an operating scale of urban rail transit is rapidly growing. Currently, urban rail transit construction has become a key focus of transportation construction in many large cities. For some coastal cities, in the past, elevated lines are usually used to connect two sides of a bay region. However, a cross-sea elevated bridge is greatly affected by weather, but also has an impact on shipping and shipping routes on a sea surface. Therefore, in recent years, more coastal cities have begun to consider construction of cross-sea underground lines. A burial depth of a cross-sea subway tunnel usually reaches a submarine rock stratum. Therefore, a subway station should be set up not far from both ends of a cross-sea section to ensure smooth travel for residents on the two sides. In this case, if a traditional shallowly-buried integrated station is adopted, a subway line will have an excessive profile grade, which is not conducive to safe driving. If a deeply-buried integrated station is adopted, neither an open excavation method nor an underground excavation method is economically reasonable. If stations on the two sides are moved further away, although requirements for opening to traffic on the two sides and a profile grade of the line are met, convenience of the urban rail transit is reduced.

Therefore, to overcome the above-mentioned defects, a designer of the present disclosure concentrates on research and design, and designs a delaminated subway station structure in a sea-land connection region and a construction method thereof based on years of experience and achievements in related industries.

SUMMARY OF PRESENT INVENTION

An objective of the present disclosure is to provide a delaminated subway station structure in a sea-land connection region and a construction method thereof, to overcome a disadvantage that a burial depth of a traditional integrated station is greatly controlled by a burial depth of a line, leverage an advantage of a shallowly-buried station hall while ensuring a gentle longitudinal slope of a cross-sea line, reduce a construction cost, improve construction efficiency, and alleviate pressure of fire evacuation during operation. A construction method in which tunnel construction is prior to station construction is conducive to quickly completing tunnel construction of the entire line, so as to complete rail construction and provide electricity in a timely manner, thus facilitating early opening to traffic. A construction method in which a station hall is excavated by using an open excavation method and a platform floor is excavated by using an underground excavation method effectively avoids shortcomings of using only the open excavation method or the underground excavation method, such as a limited working face, a long construction period, a high cost, and a high difficulty.

To achieve the above objective, the present disclosure provides a delaminated subway station structure in a sea-land connection region, including an openly-excavated station hall, a platform floor, a #1 air shaft duct, a #2 air shaft, up and down entrances and exits, a barrier-free entrance and exit, and an under-rail street passage, where the platform floor is formed by expanding an existing running tunnel, and thus includes an expanded existing running tunnel and expanded ear chambers located on two sides, such that a double-vault structure of the platform floor is formed; the #1 air shaft duct includes a #1 air shaft and a #1 air duct, and the #1 air shaft is an existing cross-sea section air shaft; the #2 air shaft is a newly built station air shaft; two groups of up and down entrances and exits are disposed, and located in waiting regions on two sides respectively to connect the expanded ear chambers on the two sides and the openly-excavated station hall; two groups of barrier-free entrances and exits are disposed, and located in the waiting regions on the two sides respectively; and the under-rail street passage is closely attached to a bottom plate of the existing running tunnel to form an underpass and connects to the expanded ear chambers on the two sides.

A construction method for the detached subway station structure in a sea-land connection region is also provided. In the construction method, tunnel construction is prior to station construction, and open excavation is combined underground excavation method. Open excavation construction is adopted for the openly-excavated station hall, and underground excavation construction is adopted for the platform floor.

The open excavation construction includes following steps:

Step A1: leveling a site.

Step A2: excavating earthwork in a foundation pit downwards until a designed elevation of a bottom of the foundation pit is reached.

Step A3: constructing the #1 air shaft downwards by hanging a shaft wall upside down, excavating the earthwork segment by segment from top to bottom, providing support during the excavation, performing shotcreting with wire mesh, setting up a grid steel frame, installing a steel support or an anchor bolt, and building an ingate to enter the tunnel to construct the air duct after an elevation of an upper step of the air duct is reached.

Step A4: laying a waterproof layer, and performing secondary lining formwork construction for the air shaft from bottom to top.

Step A5: unwatering the foundation pit, laying a waterproof layer, and constructing a second lining structure of the openly-excavated station hall from bottom to top.

In the step A2, the foundation pit adopts a soil-nail wall for support and C25 concrete for slope protection. A surface layer thickness is 100 mm, a Φ8@150 mm×150 mm reinforcing mesh is used, and a reinforcing rib is set up horizontally and vertically along a soil nail, and is weld with the soil nail.

The step A3 further includes following sub-steps:

Step A3.1: when the #1 air shaft is excavated to the upper step of the #1 air duct, providing advance support for the air duct, and disposing an advanced small conduit for an arch.

Step A3.2: building an ingate for a vertical shaft, entering the air duct through the ingate for construction, removing an initial support of the vertical shaft, and setting up a steel frame at an entrance of the tunnel for strengthening.

Step A3.3: excavating the #2 air duct by using a bench mining method, dividing the air duct into three layers based on a height for excavation and support, with an excavation footage for each cycle not more than 1 m and a spacing between tunnel faces of upper and lower steps not less than 4 m, and after each cycle of excavation, setting up a steel frame in a timely manner and closing the tunnel faces.

Step A3.4: laying a waterproof layer at an intersection of the air duct and the vertical shaft after the excavation, and performing secondary lining formwork construction.

Step A3.5: laying a waterproof layer, and performing formwork construction for the air duct from bottom to top.

The underground excavation construction includes following construction steps:

Step B1: setting up a construction-specific temporary steel frame in the existing running tunnel, applying 100 kN prestressing force, and filling a gap with slightly expanded C20 fine aggregate concrete after setting up the temporary steel frame.

Step B2: determining a location of a door opening for a passenger to get on and off, and axially staggering corresponding locations of sidewalls on the two sides of the existing running tunnel to remove a secondary lining structure of the tunnel.

Step B3: pouring a reinforced ring beam of the door opening by using a formwork, removing concrete of the door opening for alternate bay construction, where concrete of door openings on the two sides of the existing running tunnel is not removed at the same time, and after the reinforced ring beam of the door opening reaches designed strength, performing construction on a surrounding door opening.

Step B4: after removing the existing secondary lining structure, drilling a circle of shock-absorbing holes along an axis of the shock-absorbing hole around a section of the door opening, then gradually obtaining the ear chambers on the two sides through raising and expanded excavation, with a footage of 0.5 m each time, and providing anchor-plate retaining for the arch in a timely manner, where an initial-support reinforcing mesh of the arch is welded with an initial-support reinforcing mesh of the existing running tunnel to form a whole.

Step B5: excavating sections of the ear chambers on the two sides by using the bench mining method, and combining static crushing and controlled blasting to complete blasting.

Step B6: constructing a waterproofing and drainage system, and constructing a second lining segment by segment through formwork jumping.

Step B7: repeating the above steps until the ear chambers on the two sides are completely constructed, and removing a temporary support after the secondary lining structure reaches designed strength.

Step B8: constructing a mid-partition wall, an air duct on a top of a rail, and other internal structures.

In the step B3, waterproofing is carried out on an interface between new and existing concrete, including: laying a waterproof membrane, installing a grouting pipe and a water-saving storage box, and installing a longitudinal DN100 drainage pipe on an upper part of the ring beam, which is connected to an initial-support inverted layer of the running tunnel through a vertical blind drainage pipe, and to a drainage ditch through a section drainage system.

The step B2 includes following sub-steps:

Step B2.1: performing construction wiring, and planting a lifting anchor bolt to facilitate concrete lifting and construction.

Step B2.2: determining a size of a cut block based on a construction lifter, marking a segmented water-drill cutting region, and using a water drill for concrete cutting.

Step B2.3: removing concrete at the reinforced ring beam of the door opening along a water-drill cutting edge by means of manual chiseling, and retaining an original reinforcing steel bar.

The retained reinforcing steel bar is at least 50 mm longer than a height of the reinforced ring beam of the door opening, and an edge of the water-drill cutting region is deviated 100 mm inward from an inner edge of the reinforced ring beam of the door opening.

The step B5 includes following sub-steps:

Step B5.1: disposing shock-absorbing holes on a half section close to a structure of the existing running tunnel, including three rows of shock-absorbing holes on a side, two rows of staggered Φ100 mm@300 mm×300 mm shock-absorbing holes on a top, and one row of shock-absorbing holes at a bottom, and disposing a Φ90PE pipe in the holes.

Step B5.2: excavating an upper step region close to the existing running tunnel through the static crushing, and spraying 50 mm concrete after the excavation to close the tunnel face.

Step B5.3: excavating an upper step region away from the existing running tunnel through the controlled blasting, and spraying 50 mm concrete after the excavation to close the tunnel face.

Step B5.4: excavating a lower step region close to the existing running tunnel through the static crushing, wherein a spacing between the upper and lower steps ranges from 4 m to 6 m.

Step B5.5: excavating a lower step region away from the existing running tunnel 1 through the controlled blasting, wherein a spacing between the upper and lower steps ranges from 4 m to 6 m.

A ratio of area excavated through the static crushing to area excavated through the controlled blasting is not less than 1:4.

From the above, it can be seen that the delaminated subway station structure in a sea-land connection region and the construction method thereof in the present disclosure have following effects:

1. The delaminated station structure can ensure that an overall burial depth of a station is not controlled by a rail surface elevation, and a station hall and a platform are basically separated in structure and construction. The separation in the structure reduces a structural section, optimizes a force bearing form, and improves structural quality. The separation in the construction increases working faces, and construction periods of the station hall and platform are relatively independent. From an operational perspective, for a delaminated station, a platform is relatively independent of a station hall. When a fire occurs, passengers are safe in up and down entrance and exit regions. Therefore, for an operator, pressure of fire evacuation can be alleviated.

2. The construction method in which the tunnel construction is prior to the station construction can improve flexibility of construction period arrangement and alleviate construction period pressure. When a construction period of the station is affected by land acquisition and relocation, joint development of surrounding properties, and other factors, the construction method in which the tunnel construction is prior to the station construction can complete tunnel construction of an entire line in a timely manner. After the tunnel construction is completed, rail laying and other work can be started for the entire line in a timely manner, promoting early and high-quality opening of the line. Especially for coastal cities, achieving a connection between two sides as soon as possible can bring great convenience to urban life.
3. In the construction method in which the open excavation method is combined with the underground excavation method, the station hall is excavated by using the open excavation method, and the platform is excavated by using the underground excavation method. As mentioned in the first beneficial effect, the separation in the construction increases the working faces, which can improve construction efficiency and shorten the construction period. Only the station hall is excavated by using the open excavation method, which can fully leverage advantages of simpleness, high efficiency, and a low cost of the open excavation method. A platform of the existing running tunnel is expanded by using the underground excavation method, which can increase working faces of underground excavation, effectively shorten the construction period of the platform, and ensure completion of the entire line based on a scheduled construction period.

The detailed content of the present disclosure can be obtained from the following description and the accompanying drawings.

REFERENCE NUMERALS

Figure 1:
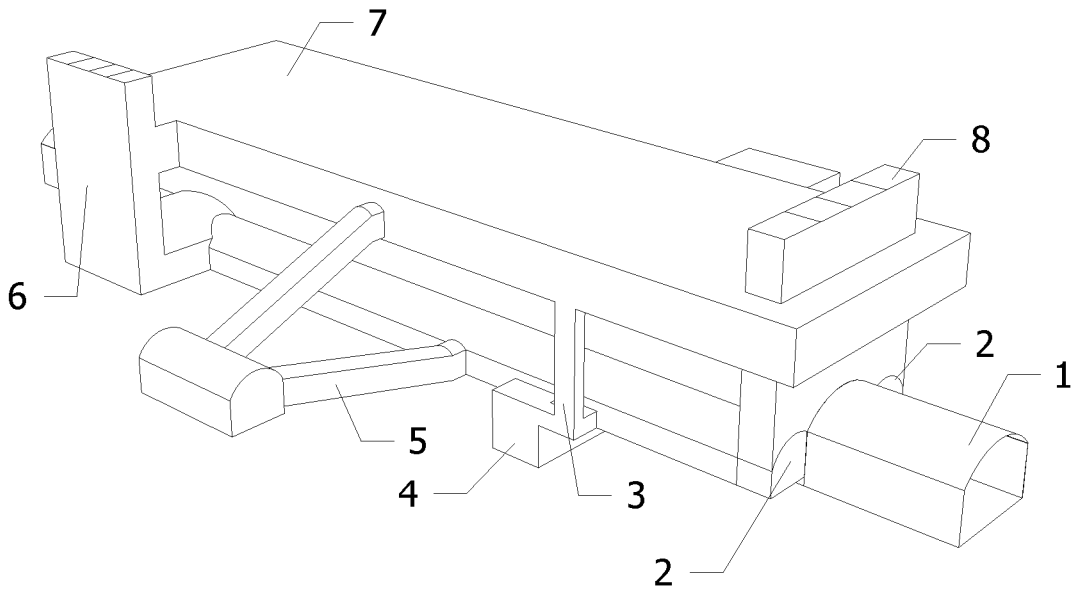
FIG. 1 is a schematic diagram of a delaminated subway station structure in a sea-land connection region according to the present disclosure.

1. existing running tunnel; 2. expanded ear chamber; 3. barrier-free entrance and exit; 4. under-rail street passage; 5. up and down entrances and exits; 6. #1 air shaft duct; 7. openly-excavated station hall; 8. #2 air shaft; 61. #1 air shaft; 62. #1 air duct; 21. door opening; 211. reinforced ring beam of the door opening; 22. platform; 23. waterproofing and drainage system; 63. steel frame; 64. waterproof layer; 91. temporary support steel frame; 92. axis of a shock-absorbing hole; 93. cutting edge; 94. shock-absorbing hole.

DETAILED DESCRIPTION OF THE EMBODIMENTS

FIG. 1 to FIG. 8F show a delaminated subway station structure in a sea-land connection region and a construction method thereof.

As shown in FIG. 1 to FIG. 3, FIG. 5, and FIG. 6, the delaminated subway station structure in a sea-land connection region in the present disclosure includes an openly-excavated station hall 7, a platform floor, a #1 air shaft duct 6, a #2 air shaft 8, up and down entrances and exits 5, a barrier-free entrance and exit 3, and an under-rail street passage 4.

The platform floor is formed by expanding an existing running tunnel 1, and thus includes an expanded existing running tunnel 1 and expanded ear chambers 2 located on two sides. In this way, a double-vault structure of the platform floor is formed. The existing running tunnel 1 mainly serves as a rail region, while the expanded ear chamber 2 serves as a waiting region and an equipment region. Therefore, the platform floor is a side platform.

The air shaft duct in the present disclosure is structurally formed by the #1 air shaft duct 6 and the #2 air shaft 8, which are respectively disposed at large and small mileage ends of the station. The #1 air shaft duct 6 includes a #1 air shaft 61 and a #1 air duct 62. The #1 air shaft 61 is an existing cross-sea section air shaft, that is, the #1 air shaft 61 simultaneously undertakes ventilation functions of the station and the existing running tunnel 1. The #2 air shaft 8 is a newly built station air shaft. Therefore, in the present disclosure, the section air shaft and the station air shaft are jointly constructed, which is conducive to reducing a work amount, lowering a construction cost, and shortening a construction period.

Two groups of up and down entrances and exits 5 are disposed, and located in waiting regions on two sides respectively to connect the expanded ear chambers 2 on the two sides and the openly-excavated station hall 7. In this way, passengers can enter and leave a station hall floor and the platform floor.

Two groups of barrier-free entrances and exits 3 are disposed, and located in the waiting regions on the two sides respectively to connect the expanded ear chambers on the two sides and the station hall. In this way, the passengers can enter and leave the station hall and the platform.

The under-rail street passage 4 is closely attached to a bottom plate of the existing running tunnel 1 to form an underpass and connects to the expanded ear chambers 2 on the two sides to enable passengers on two sides of the side platform to transfer between left and right lines.

Figure 2:
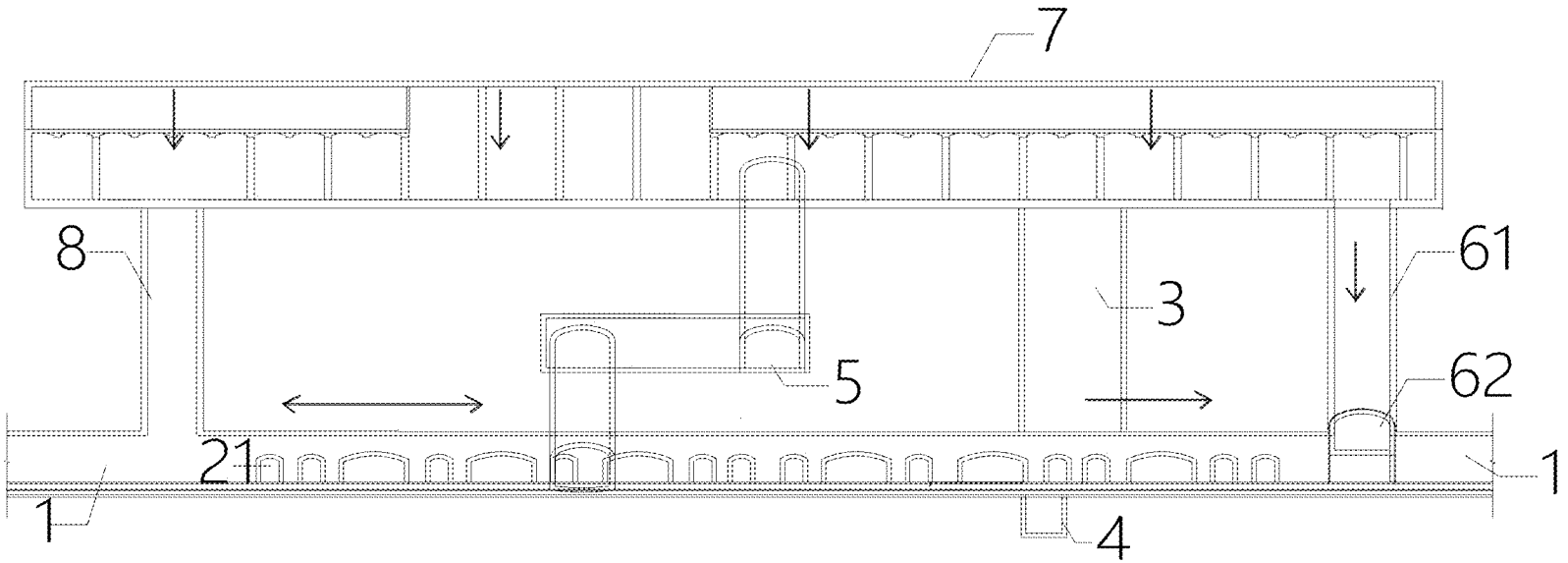
FIG. 2 is a schematic diagram of a longitudinal profile and a construction sequence of a station according to the present disclosure.
Figure 3:
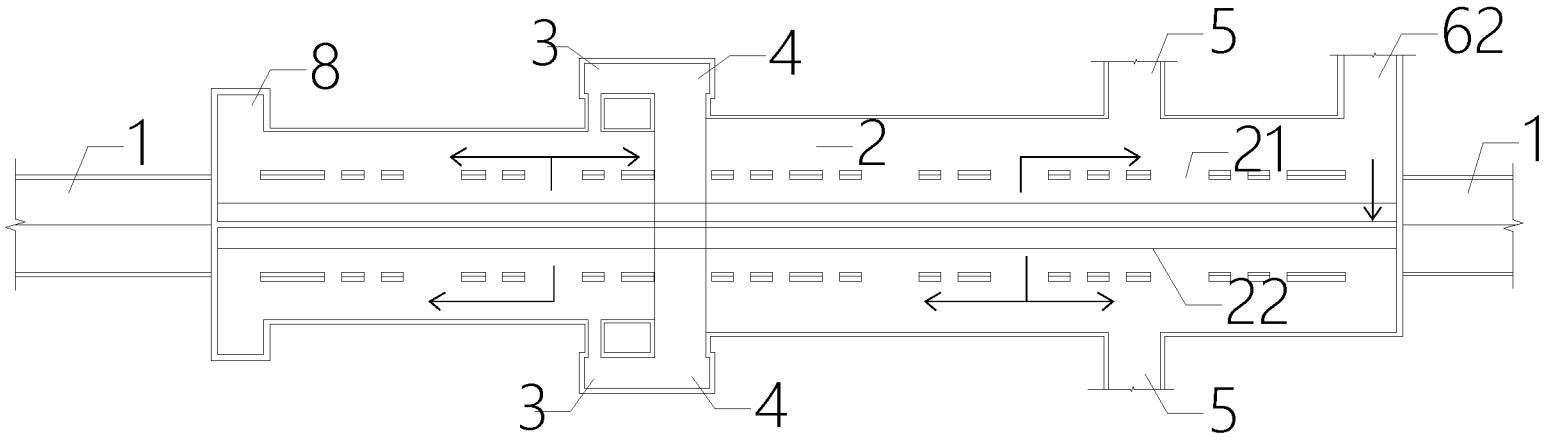
FIG. 3 is a schematic diagram of a plan and a construction sequence of a platform floor according to the present disclosure.

FIG. 2 and FIG. 3 show the construction method for the detached subway station structure in a sea-land connection region in the present disclosure. In the construction method, tunnel construction is prior to station construction, and an open excavation method is combined with an underground excavation method. The openly-excavated station hall 7 is constructed by using the open excavation method, and the platform floor is constructed by using the underground excavation method. Particularly, the platform floor constructed by using the underground excavation method is formed by expanding the existing running tunnel 1, a working face of the openly-excavated station hall 7 is a surface of the earth, and both the platform floor and the openly-excavated station hall can be excavated in a same construction period. Therefore, the construction method for the detached subway station structure in a sea-land connection region in the present disclosure can include simultaneous construction steps of open excavation construction and underground excavation construction.

Specifically, the open excavation construction includes following steps.

In step A1, a site is leveled. In this embodiment, the site is currently vacant and a surrounding environment is simple. Therefore, the site can be leveled through step-slope excavation.

In step A2, earthwork in a foundation pit is excavated downwards until a designed elevation of a bottom of the foundation pit is reached. The foundation pit adopts a soil-nail wall for support and C25 concrete for slope protection. A surface layer thickness is 100 mm, and a @8@150 mm×150 mm reinforcing mesh is used. A reinforcing rib is set up horizontally and vertically along a soil nail, and is weld with the soil nail.

In step A3, the #1 air shaft is constructed downwards by hanging a shaft wall upside down. The earthwork is excavated segment by segment from top to bottom, and support is provided during the excavation. Shotcreting with wire mesh is performed. A grid steel frame is set up in a timely manner. A steel support or an anchor bolt is installed at a specific location in a timely manner. An ingate is built to enter the tunnel to construct the air duct after an elevation of an upper step of the air duct is reached.

Referring to FIG. 4A to FIG. 4E, the step A3 may further include following sub-steps.

Figure 4A:
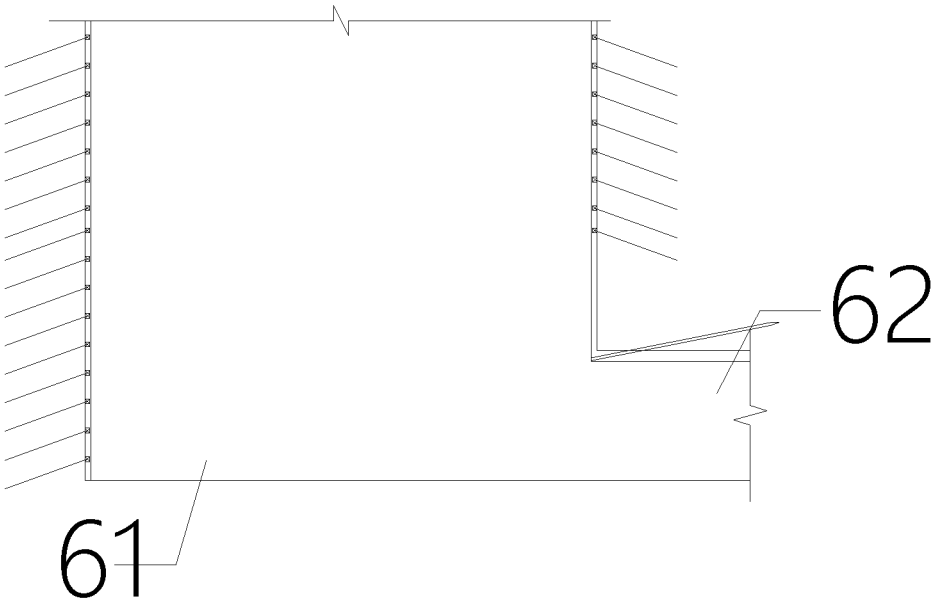
FIG. 4A to FIG. 4E show a construction sequence of an air inlet duct of a shared air shaft according to the present disclosure.

In step A3.1, as shown in FIG. 4A, when the #1 air shaft 61 is excavated to the upper step of the #1 air duct 62, advance support is provided for the air duct, and an advanced small conduit is disposed for an arch.

Figure 4B:
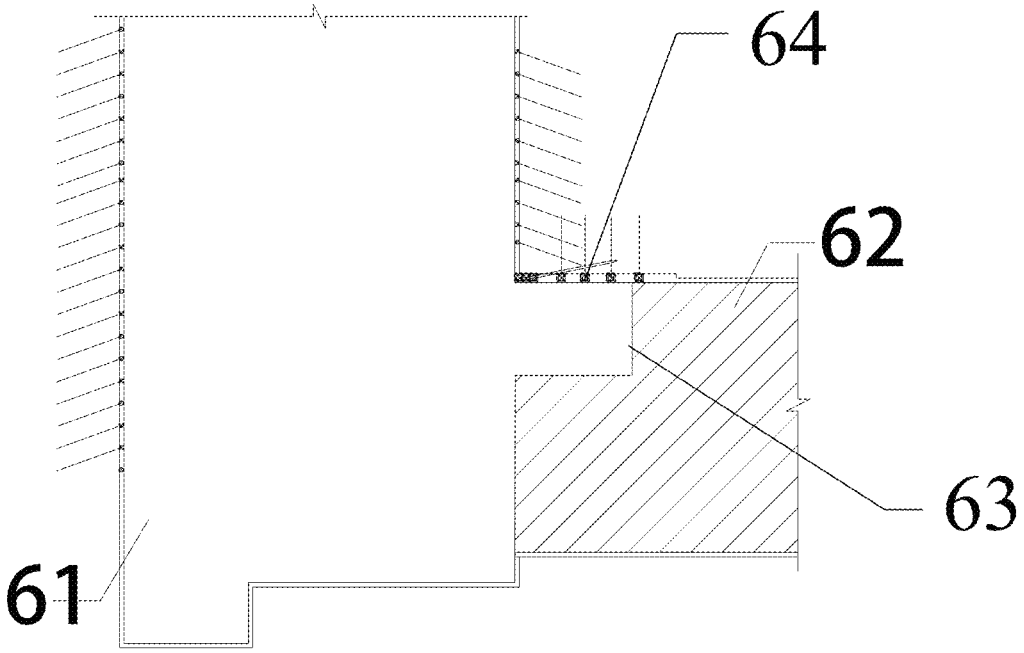

In step A3.2, as shown in FIG. 4B, an ingate is built for a vertical shaft, the air duct is entered through the ingate for construction, an initial support of the vertical shaft is removed, and a steel frame is set up at an entrance of the tunnel for strengthening.

Figure 4C:
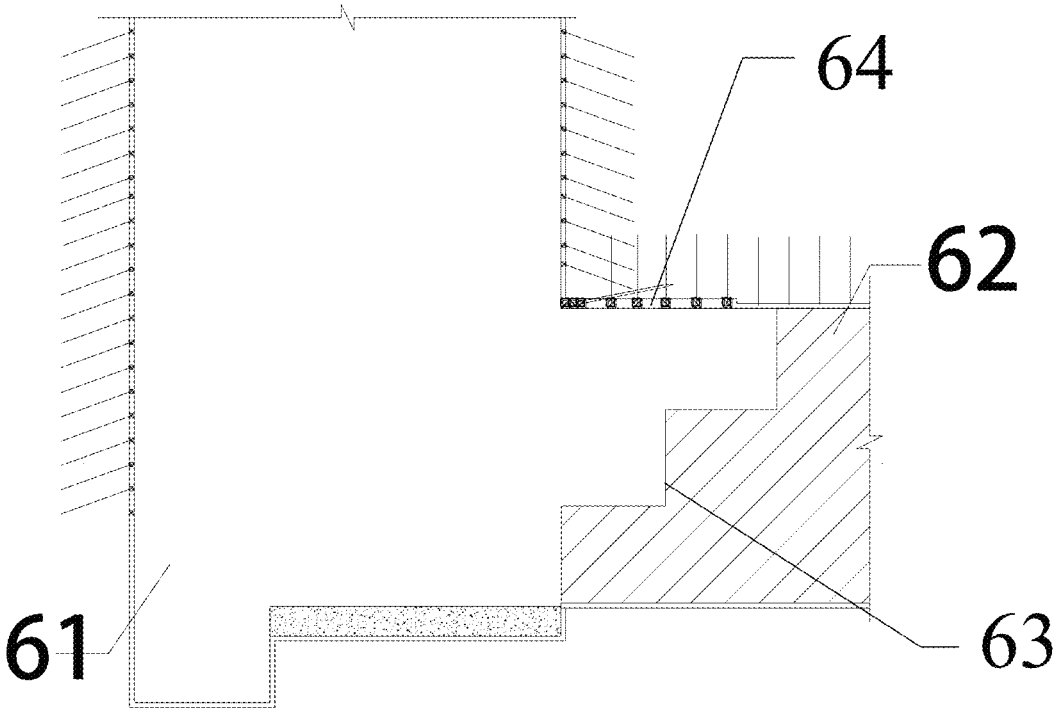

In step A3.3, as shown in FIG. 4C, the #1 air duct 62 is excavated by using a bench mining method. The air duct is into three layers based on a height for excavation and support, with an excavation footage for each cycle not more than 1 m and a spacing between tunnel faces of upper and lower steps not less than 4 m. After each cycle of excavation, a steel frame should be set up in a timely manner, and the tunnel faces are closed.

Figure 4D:
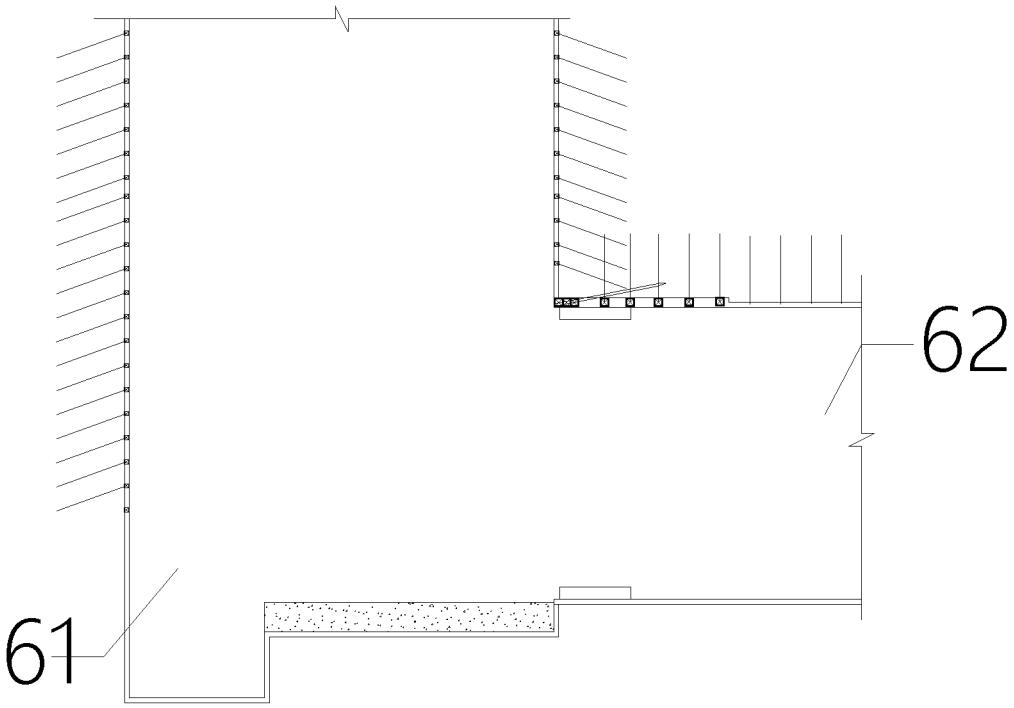

In step A3.4, as shown FIG. 4C and FIG. 4D, a waterproof layer should be laid within a range of an intersection of the air duct and the vertical shaft after the excavation, and secondary lining formwork construction is performed.

Figure 4E:
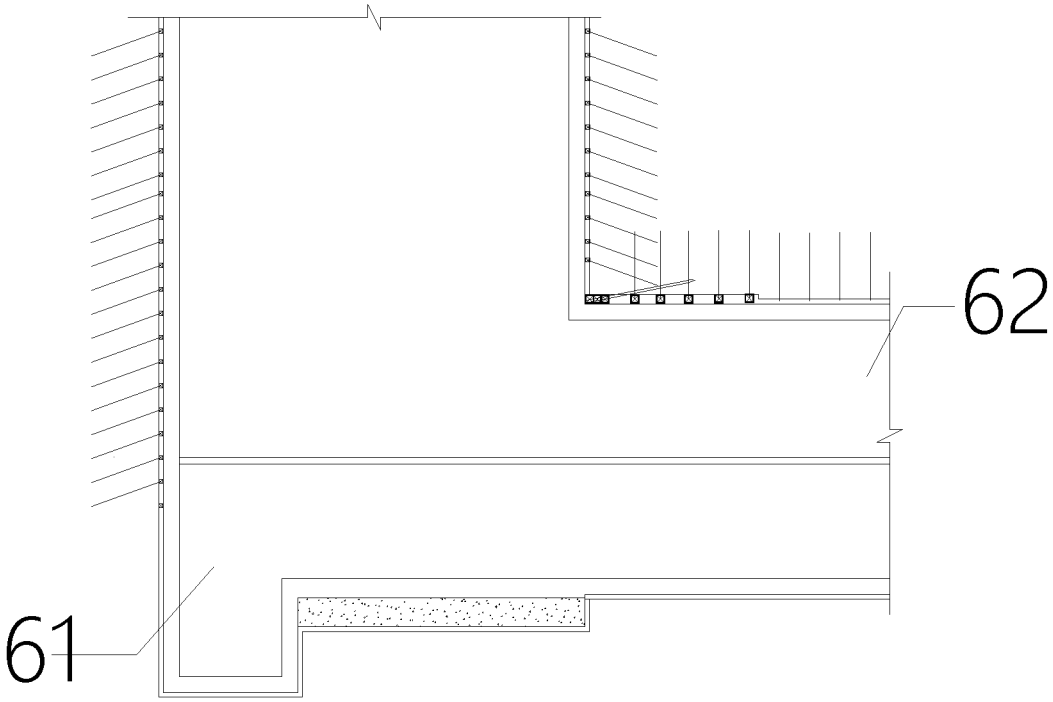
Figure 5:
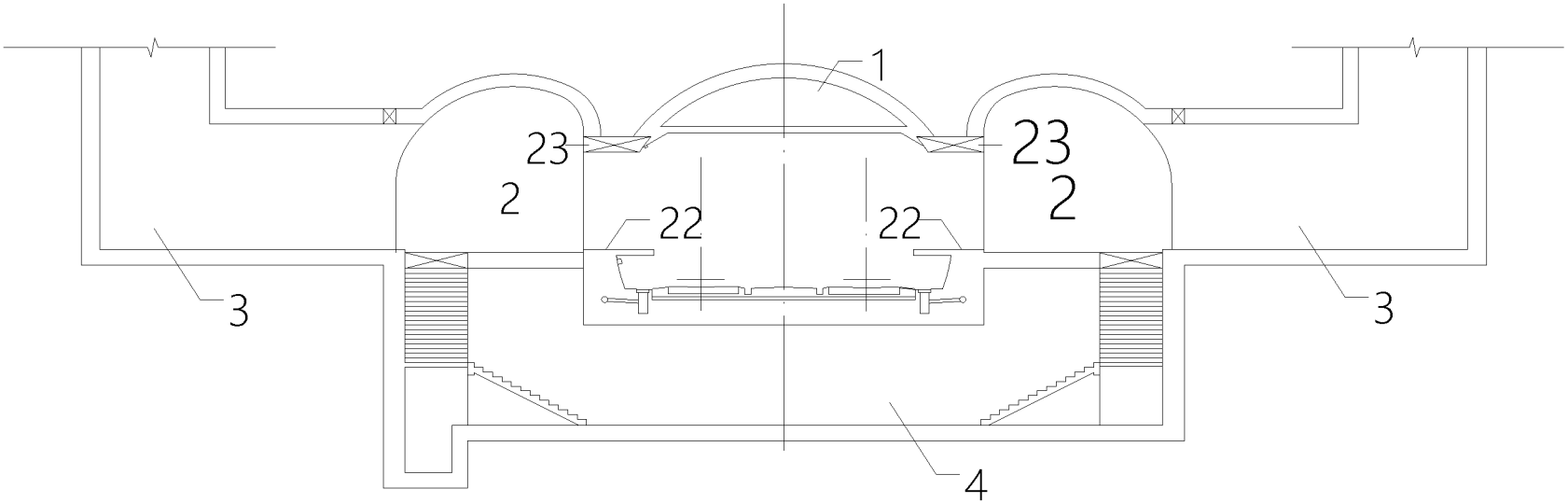
FIG. 5 is a cutaway view of an underground-excavated structure at an under-rail street passage according to the present disclosure.
Figure 6:
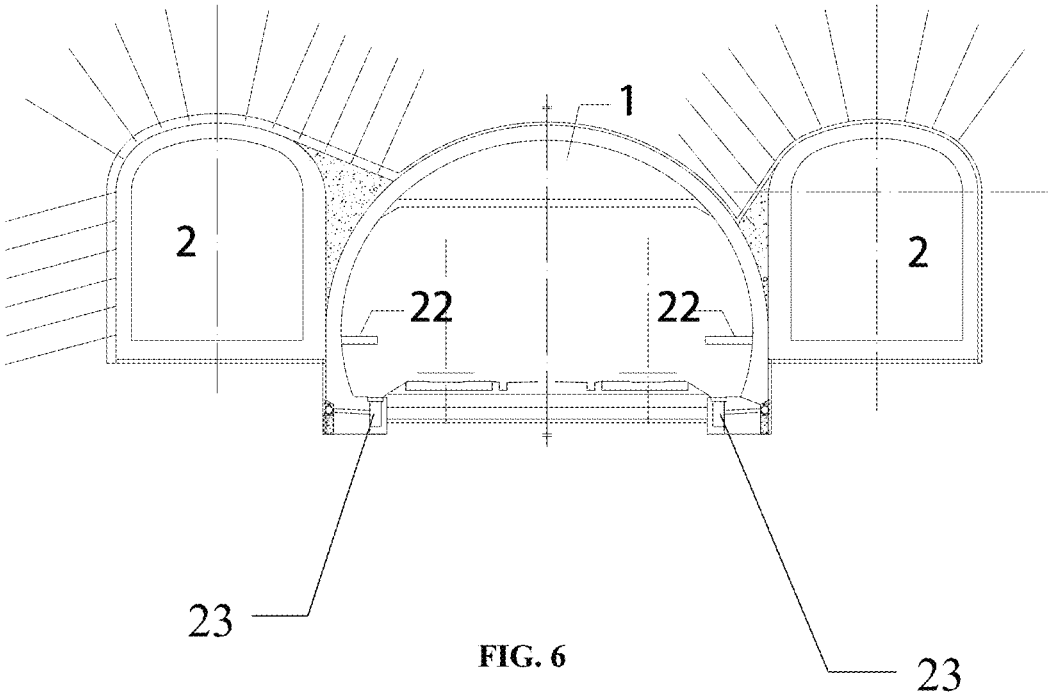
FIG. 6 is a cutaway view of a platform floor according to the present disclosure.

In step A3.5, as shown in FIG. 4E, a waterproof layer is laid, and formwork construction is performed for the air duct from bottom to top.

In step A4, a waterproof layer is performed, and secondary lining formwork construction is performed for the air shaft from bottom to top.

In step A5, the foundation pit is unwatered, a waterproof layer is laid, and a second lining structure of the openly-excavated station hall is constructed from bottom to top.

The above steps are based on the openly-excavated station hall. The air shaft is constructed downwards from the station hall by hanging the shaft wall upside down, achieving joint construction of the station air shaft and the section air shaft. The section air shaft and the station air shaft are shared, which can effectively reduce the work amount and the construction cost. The air shaft can provide a temporary entrance for underground excavation workers and equipment, as well as a taphole, which avoids a waste of a temporary vertical shaft. After the ingate is built to enter the tunnel to construct the air duct, a new working section can be provided for an underground-excavated platform, which is beneficial for shortening the construction period.

Referring to FIG. 7 and FIG. 8A to FIG. 8F, the underground excavation construction includes following construction steps.

In step B1, a construction-specific temporary steel frame 91 is set up in the existing running tunnel 1, and 100 kN prestressing force is applied. Before the construction, a size of an existing section needs to be verified. A gap is filled with slightly expanded C20 fine aggregate concrete after the temporary steel frame 91 is set up.

In step B2, a location of a door opening 21 for a passenger to get on and off is determined, and corresponding locations of sidewalls on the two sides of the existing running tunnel 1 are axially staggered to remove a secondary lining structure of the tunnel.

Figure 7:
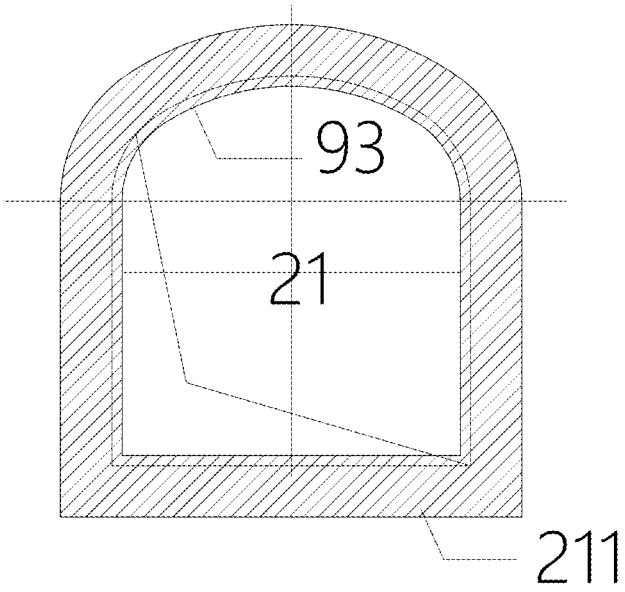
FIG. 7 is a schematic diagram of a method for dismantling a door opening of an existing running tunnel according to the present disclosure.

As shown in FIG. 7, the step B2 may include following sub-steps.

In step B2.1, construction wiring is performed, and a lifting anchor bolt is planted to facilitate concrete lifting and construction. A pull-out test needs to be performed for the lifting anchor bolt in advance, and an impact of a lifting load needs to be considered.

In step B2.2, a size of a cut block is reasonably designed each time based on a construction lifter. After a segmented water-drill cutting region is marked, a water drill is used for concrete cutting. It is recommended that the cutting holes having a diameter of @100 mm with 90 mm between two adjacent circle center during cutting.

In step B2.3, concrete 211 at the reinforced ring beam of the door opening is removed along a water-drill cutting edge 93 by means of manual chiseling, and an original reinforcing steel bar is retained. Reference may be made to a shaded region in FIG. 7.

Particularly, to meet an anchoring requirement of the reinforcing steel bar, the retained reinforcing steel bar is at least 50 mm longer than a height of the reinforced ring beam 211 of the door opening (if the height of the reinforced ring beam 211 of the door opening is 500 mm, the retained reinforcing steel bar is at least 550 mm). Therefore, it is recommended that an edge of the water-drill cutting region is deviated 100 mm inward from an inner edge of the reinforced ring beam of the door opening, as shown in FIG. 7. It is not recommended to connect the existing running tunnel 1 and the reinforced ring beam of the door opening through bar planting. If the original reinforcing steel bar still does not meet a force-bearing requirement after being anchored, the bar planting can be properly performed as an auxiliary reinforcement measure.

In step B3, the reinforced ring beam 211 of the door opening is poured by using a formwork. Concrete of the door opening is removed for alternate bay construction. Concrete of door openings on the two sides of the existing running tunnel 1 cannot be removed at the same time. After the reinforced ring beam 211 of the door opening reaches designed strength, construction can be performed on a surrounding door opening. The construction of the reinforced ring beam of the door opening involves a connection between new and existing concrete, and the existing concrete must be roughened and cleaned. Waterproofing needs to be carried out on an interface between the new and existing concrete. Specifically, a waterproof membrane is laid, a grouting pipe and a water-saving storage box are installed, and a longitudinal DN100 drainage pipe is installed on an upper part of the ring beam, which is connected to an initial-support inverted layer of the running tunnel through a vertical blind drainage pipe, and to a drainage ditch through a section drainage system.

Figure 8A:
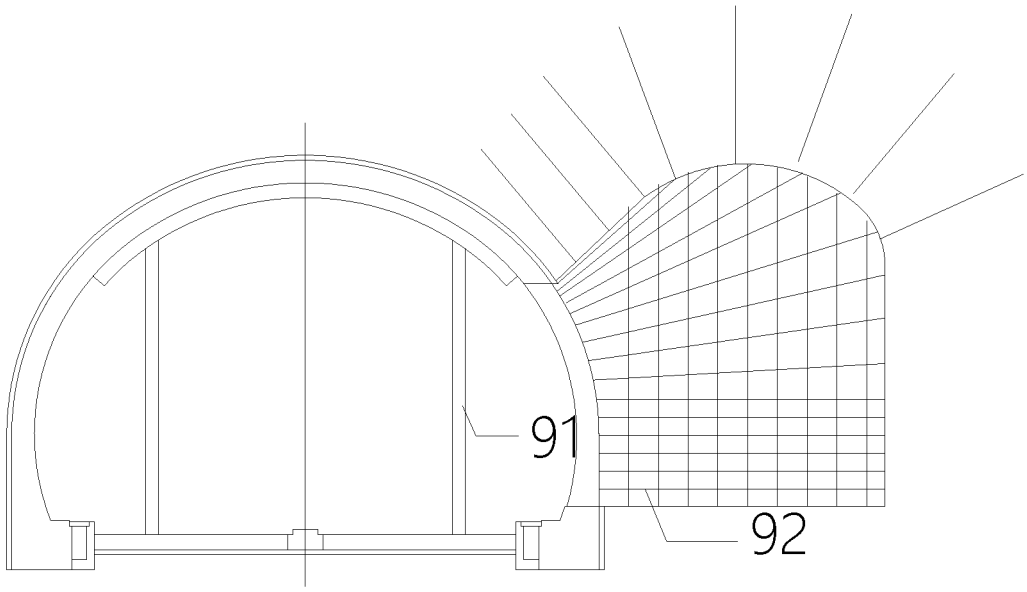
FIG. 8A to FIG. 8F are a schematic diagram of platform expansion steps when tunnel construction is prior to station construction according to the present disclosure.

In step B4, referring to FIG. 8A, after the existing secondary lining structure is removed, a circle of shock-absorbing holes is drilled along an axis of the shock-absorbing hole 92 around a section of the door opening. Then, the ear chambers 2 on the two sides are gradually obtained through raising and expanded excavation, with a footage of 0.5 m each time. Anchor-plate retaining is provided for the arch in a timely manner. An initial-support reinforcing mesh of the arch should be welded with an initial-support reinforcing mesh of the existing running tunnel 1 to form a whole.

In step B5, sections of the ear chambers on the two sides are excavated by using the bench mining method. Construction according to the bench mining method can achieve more blasting free faces. Static crushing and controlled blasting are combined to complete blasting.

Figure 8B:
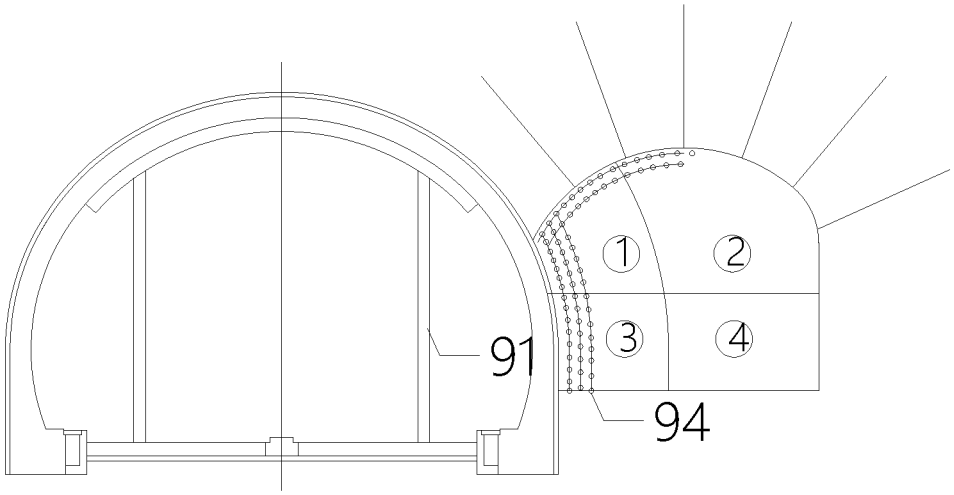

Referring to FIG. 8B, the step B5 may include following sub-steps.

In step B5.1, shock-absorbing holes 94 are disposed on a half section close a structure of the existing running tunnel 1, including three rows of shock-absorbing holes on a side, two rows of staggered ¢100 mm@300 mm×300 mm shock-absorbing holes on a top, and one row of shock-absorbing holes at a bottom. A Φ90PE pipe is disposed in the holes. The shock-absorbing holes shall not be less than 20 m long for each cycle, with 5 m reserved. Monitoring needs to be enhanced.

In step B5.2, an upper step region close to the existing running tunnel 1 (region ① shown in FIG. 8B) is excavated through the static crushing. After the excavation, 50 mm concrete is sprayed to close the tunnel face.

In step B5.3, an upper step region away from the existing running tunnel 1 (region ② shown in FIG. 8B) is excavated through the controlled blasting. After the excavation, 50 mm concrete is sprayed to close the tunnel face.

In step B5.4, a lower step region close to the existing running tunnel 1 (region ③) shown in FIG. 8B) is excavated through the static crushing. A spacing between the upper and lower steps ranges from 4 m to 6 m.

In step B5.5, a lower step region away from the existing running tunnel 1 (region ④) shown in FIG. 8B) is excavated through the controlled blasting. A spacing between the upper and lower steps ranges from 4 m to 6 m.

Preferably, a ratio of area excavated through the static crushing to area excavated through the controlled blasting is not less than 1:4.

In step B6, a waterproofing and drainage system is constructed, and a second lining is constructed segment by segment through formwork jumping.

Figure 8C:
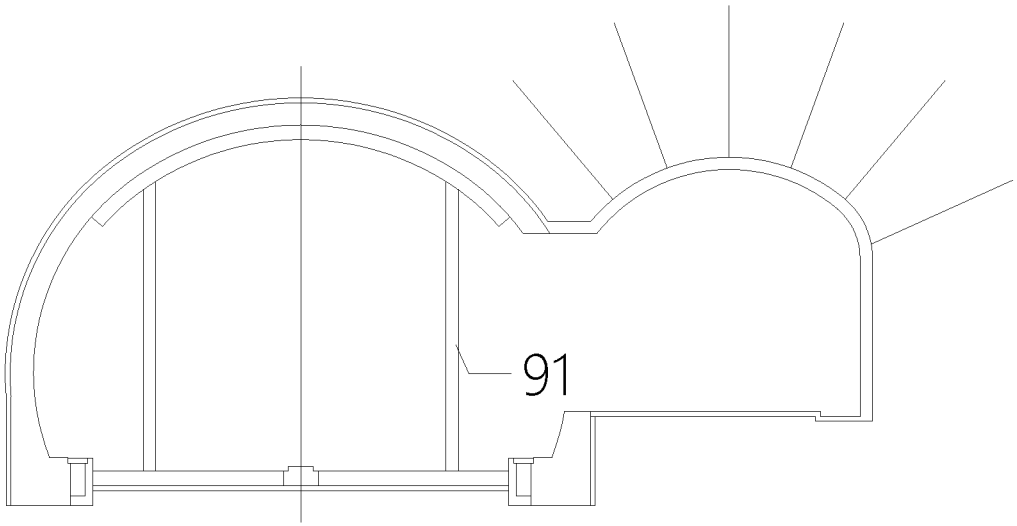

Door opening construction sequences in the steps B2 and B3 should be determined based on a location of the tunnel face. A distance between an opening location and the tunnel face should not be less than 1.5 times an excavation span, as shown in FIG. 8C.

Figure 8D:
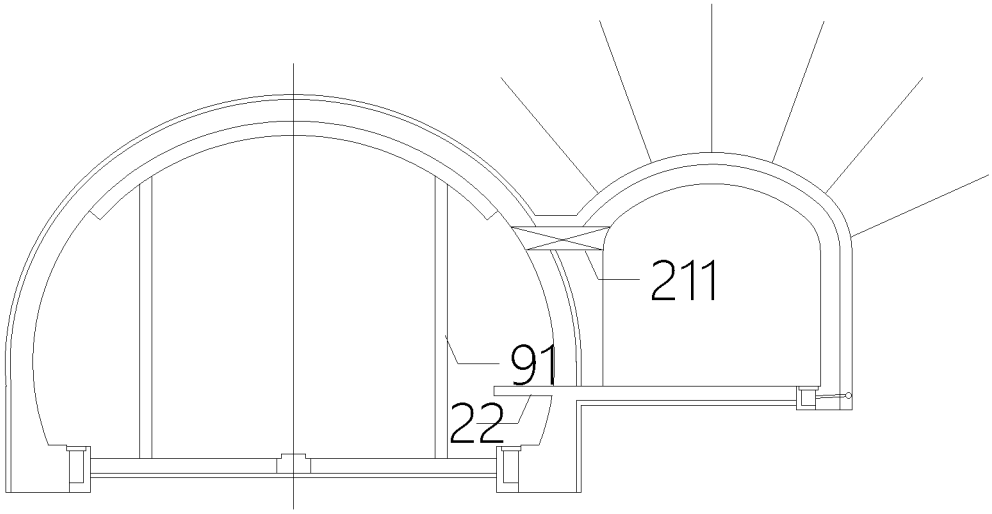

The construction of the second lining segment by segment through the formwork jumping in the step B6 should be planned in conjunction with an opening sequence, as shown in FIG. 8D. This is because the reinforced ring beam 211 of the door opening is not only used for local reinforcement at a structural opening of the existing running tunnel 1, but also used for local reinforcement at a structural opening of the expanded ear chamber 2. In order to avoid a construction joint and ensure quality of structural waterproofing, second lining structures at entrances of the reinforced ring beam 211 of the door opening and the expansion ear chamber 2 on the same side should be constructed simultaneously.

Figure 8E:
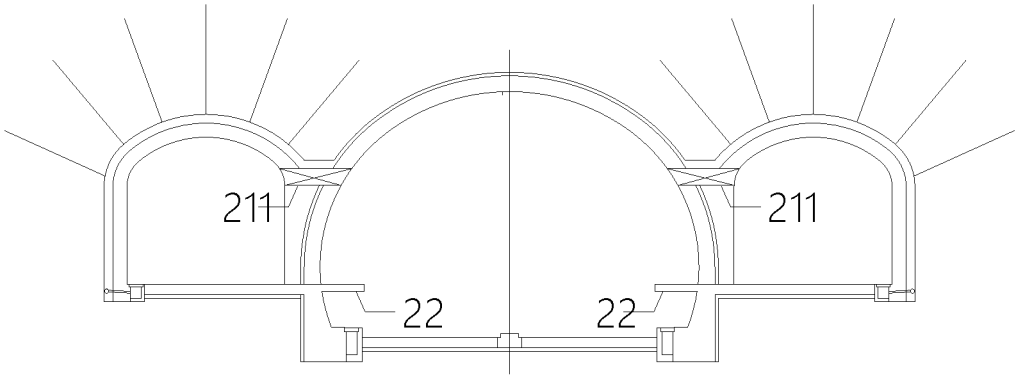

In step B7, referring to FIG. 8E, the above steps are repeated until the ear chambers on the two sides are completely constructed, and the temporary support 91 is removed after the secondary lining structure reaches the designed strength.

Figure 8F:
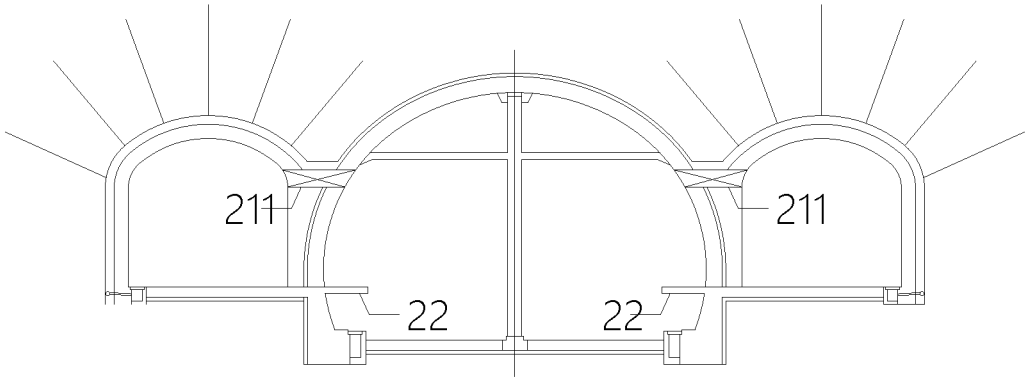

In step B8, referring to FIG. 8F, a mid-partition, an air duct on a top of a rail, and other internal structures are constructed.

Therefore, the construction steps of expanding the platform in the existing running tunnel in the present disclosure can be divided into two types of parallel work: tunneling the expanded ear chamber along a direction of the running tunnel, and breaking a structure of the existing running tunnel to excavate the door opening for the passenger to get on and off. There are two types of tunnel faces for tunneling the expanded ear chamber: building the ingate through the air duct to enter the tunnel, and removing the door opening of the existing running tunnel and then obtaining the section of the ear chamber through the raising and the expanded excavation. The excavation blasting of the expanded ear chamber is described in steps B4 to B6, and the construction of the door opening is detailed in steps B1 to B3. These two types of work can be carried out simultaneously.

Therefore, the present disclosure has following advantages:

1. A station hall and a platform are structurally separated, which avoids a limitation that an overall burial depth of a traditional integrated station is greatly controlled by a burial depth of a line. As a first station at a cross-sea end of a section, a designed delaminated station can not only meet a design requirement of the line, but also effectively reduce a difficulty of civil construction, shorten a construction period, and improve structural quality. In this case, the station hall and the platform will become two fire zones. For the integrated station, once a fire occurs, both the station hall and the platform are considered unsafe regions. However, for the delaminated station, the platform is relatively independent of the station hall. When a fire occurs, passengers are safe in up and down entrance and exit regions. Therefore, for an operator, pressure of fire evacuation can be alleviated.
2. A section air shaft and a station air shaft are jointly constructed. Due to a large burial depth of the line, a platform floor is greatly controlled by a burial depth of a running tunnel. It is expensive to use a construction-specific vertical shaft and inclined shaft as temporary structures, which is not economically viable. Therefore, the section air shaft and the station air shaft are shared, which can effectively reduce a work amount and a construction cost. In addition, after an ingate is built to enter the tunnel to construct an air duct, the joint construction of the shafts can provide a new working section for an underground-excavated platform, which is conducive to shortening the construction period.

3. A construction method in which tunnel construction is prior to station construction can complete tunnel construction of the entire line in a timely manner. After the tunnel construction is completed, rail laying and other work can be started for the entire line in a timely manner, promoting early and high-quality opening of the line. This can be divided into following three points:

3.1 Water-drill cutting and manual chiseling are combined to remove concrete from an existing structure. An outer edge of a water-drill cutting region is recommended to be deviated 100 mm inward from an inner edge of a reinforced ring beam of a door opening. A water-drill cutting edge to an outer edge of the reinforced ring beam of the door opening can be manually chiseled to remove concrete. This not only effectively retains an original reinforcing steel bar of the existing structure and anchors a new ring beam and a secondary lining of the tunnel, but also improves construction efficiency.

3.2 An ear chamber is expanded by means of peripheral shock-absorbing holes, static crushing, and controlled blasting. This is because the expansion of the ear chamber is a type of blasting excavation that closely attaches to the existing structure, and blasting impact significantly affects the existing structure and a surrounding rock. If only the conventional controlled blasting is used, it is likely to cause cracking of the existing tunnel structure, which can affect a service life of the structure, or even cause a construction accident. Therefore, the present disclosure proposes an ear chamber mining method that combines the peripheral shock-absorbing holes, the static crushing, and the controlled blasting. The shock-absorbing holes can play a role in pre-splitting and reducing an impact of blasting. In terms of blasting zoning, the ear chamber mining method is similar to the CD method, but actually, is still a bench mining method. During construction, static crushing construction is first performed on an upper step on a side close to the existing structure, and then controlled blasting construction is performed on an upper step on a side away from the existing structure. After that, the static crushing construction is performed on a lower step on the side close to the existing structure, and then the controlled blasting construction is performed on a lower step on the side away from the existing structure. A statically-crushed part completed in this way is equivalent to separating the existing running tunnel from a controlled blasting region. This provides a complete shock-absorbing belt for the controlled blasting region, prevents blasting vibration from being transmitted to the existing running tunnel, thereby ensuring safety of structural construction.

3.3 A construction period of the reinforced ring beam of the door opening and a construction period of second lining pouring of the expanded ear chamber need to be coordinated. In order to avoid a construction joint and ensure quality of structural waterproofing, the reinforced ring beam of the door opening and second linings on two sides should be constructed simultaneously. However, there are many working faces for underground excavating the ear chamber. During the construction, a distance between the door opening and a tunnel face should not be less than 1.5 times an excavation span to prevent tunnel face instability and other construction accidents caused by weakened structural strength. Therefore, in construction planning, a penetration speed of ear chamber construction and a progress of door opening dismantling need to be carefully coordinated.

It is obvious that the above descriptions are merely examples and not intended to limit the content, application, or use of the present disclosure. Although the description has been provided in the embodiments and the embodiments have been illustrated in the accompanying drawings, the present disclosure is not limited to specific examples described in the accompanying drawings and the embodiments as currently considered the best modes to implement the teachings of the present disclosure. The scope of the present disclosure will include any embodiments falling within the specification and the appended claims.

What is claimed is:

1. A construction method for a delaminated subway station structure in a sea-land connection region, wherein the delaminated subway station structure in the sea-land connection region comprises an openly-excavated station hall, a platform floor, a first air shaft duct, a second air shaft, up and down entrances and exits, barrier-free entrances and exits, and an under-rail street passage; the platform floor is formed by expanding an existing running tunnel, and thus comprises an expanded existing running tunnel and expanded ear chambers located on two sides, such that a double-vault structure of the platform floor is formed; the first air shaft duct comprises a first air shaft and a first air duct, and the first air shaft is an air shaft for an existing cross-sea section; the second air shaft is air shaft for a newly built station; the up and down entrances and exits are located in waiting regions on two sides respectively to connect the expanded ear chambers on the two sides and the openly-excavated station hall; the barrier-free entrances and exits are located in the waiting regions on the two sides respectively; the under-rail street passage is closely attached to a bottom plate of the existing running tunnel to form an underpass and connects to the expanded ear chambers on the two sides; and in the construction method, tunnel construction is prior to station construction, and open excavation is combined with underground excavation, wherein open excavation construction is adopted for the openly-excavated station hall, and underground excavation construction is adopted for the platform floor, wherein the open excavation construction comprises following steps:

step A1: leveling a site;

step A2: excavating earthwork in a foundation pit downwards until a designed elevation of a bottom of the foundation pit is reached;

step A3: constructing the first air shaft downwards by hanging a shaft wall upside down, excavating the earthwork segment by segment from top to bottom, performing a primary lining formwork construction including performing shotcreting with wire mesh, setting up a grid steel frame, and installing a steel support or an anchor bolt, and building an ingate to enter a tunnel to construct the first air duct after an elevation of an upper step of the first air duct is reached, wherein the step A3 further comprises following sub-steps:

step A3.1: when excavating the first air shaft to the upper step of the first air duct, constructing a shoring system for the first air duct, and disposing an advanced conduit for an arch;

step A3.2: building the ingate for the first air shaft, entering the first air duct through the ingate for construction, removing an initial support of the first air shaft, and setting up a steel frame at an entrance of the first air duct for strengthening;

step A3.3: excavating the first air duct by using a bench mining method, dividing the first air duct into three layers based on a height for excavation and support, with an excavation footage for each cycle not more than 1 m and a spacing between tunnel faces of upper and lower steps not less than 4 m, and after each cycle of excavation, setting up a steel frame in a timely manner and spraying a layer of concrete on the tunnel faces;

step A3.4: laying a waterproof layer at an intersection of the air duct and first air shaft after the excavation, and performing secondary lining formwork construction at the intersection of the air duct and the first air shaft; and step A3.5: laying a waterproof layer, and performing formwork construction for the air duct from bottom to top;

step A4: laying a waterproof layer, and performing the secondary lining formwork construction for the air shaft from bottom to top; and step A5: unwatering the foundation pit, laying a waterproof layer, and constructing a second lining structure of the openly-excavated station hall from bottom to top; wherein the second lining structure is shotcrete; and the underground excavation construction comprises following construction steps:

step B1: setting up a construction-specific temporary steel frame in the existing running tunnel, applying 100 kN prestressing force, and filling a gap between the temporary steel frame and the existing running tunnel with slightly expanded C20 fine aggregate concrete after setting up the temporary steel frame;

step B2: determining a location of a door opening for a passenger to get on and off, and axially staggering corresponding locations of sidewalls on the two sides of the existing running tunnel to remove a lining structure of the tunnel;

step B3: removing concrete of the door opening, pouring a reinforced ring beam of the door opening by using a formwork, wherein concrete of door openings on the two sides of the existing running tunnel is not removed at the same time, and after the reinforced ring beam of the door opening reaches designed strength, performing construction on a surrounding door opening;

step B4: after removing the existing secondary lining structure, drilling a circle of shock-absorbing holes along an axis of the shock-absorbing hole around a section of the door opening, then gradually obtaining the ear chambers on the two sides through raising and expanded excavation, with a footage of 0.5 m each time, providing anchor-plate retaining for the arch in a timely manner, and welding the temporary steel frame with an initial-support reinforcing mesh of the existing running tunnel to form a whole;

step B5: excavating sections of the ear chambers on the two sides by using the bench mining method, and combining static crushing and controlled blasting to complete excavation;

step B6: constructing a waterproofing and drainage system in the ear chambers, and constructing a second lining segment by segment through formwork jumping in the ear chambers;

step B7: repeating the above steps until the ear chambers on the two sides are completely constructed, and removing the temporary steel frame after the secondary lining structure reaches designed strength; and step B8: constructing a mid-partition wall, an air duct on a top of a rail, and other internal structures.

2. The construction method according to claim 1, wherein the step B2 comprises following sub-steps:

step B2.1: placing a construction lifter into the existing running tunnel to facilitate concrete lifting;

step B2.2: determining a size of a cut block based on the construction lifter, marking a segmented water-drill cutting region, and using a water drill for cutting concrete; and step B2.3: removing concrete at the reinforced ring beam of the door opening along an edge of the water-drill cutting region by means of manual chiseling, and retaining an original reinforcing steel bar.

3. The construction method according to claim 2, wherein the retained reinforcing steel bar is at least 50 mm longer than a height of the reinforced ring beam of the door opening, and the edge of the water-drill cutting region is deviated 100 mm inward from an inner edge of the reinforced ring beam of the door opening.

4. The construction method according to claim 1, wherein the step B5 comprises following sub-steps:

step B5.1: disposing shock-absorbing holes on a half section close to a structure of the existing running tunnel, comprising three rows of shock-absorbing holes on a side, two rows of staggered Φ100 mm@300 mm×300 mm shock-absorbing holes on a top, and one row of shock-absorbing holes at a bottom, and disposing a Φ90 polyethylene pipe in the holes;

step B5.2: excavating an upper step region close to the existing running tunnel through the static crushing, and spraying 50 mm concrete after the excavation to close the tunnel face;

step B5.3: excavating an upper step region away from the existing running tunnel through the controlled blasting, and spraying 50 mm concrete after the excavation to close the tunnel face;

step B5.4: excavating a lower step region close to the existing running tunnel through the static crushing, wherein a spacing between the upper and lower steps ranges from 4 m to 6 m; and step B5.5: excavating a lower step region away from the existing running tunnel through the controlled blasting, wherein a spacing between the upper and lower steps ranges from 4 m to 6 m.

5. The construction method according to claim 4, wherein a ratio of area excavated through the static crushing to area excavated through the controlled blasting is not less than 1:4.

* * * * *